US009109445B2

(12) United States Patent
Dehmel et al.

(10) Patent No.: US 9,109,445 B2
(45) Date of Patent: Aug. 18, 2015

(54) SHIELD CANOPY FOR A SHIELD-TYPE SUPPORT

(75) Inventors: Dennis Dehmel, Lunen (DE); Detlef Hahn, Lunen (DE); Stefan Hengstler, Lunen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 13/510,471

(22) PCT Filed: Nov. 16, 2010

(86) PCT No.: PCT/IB2010/055189

§ 371 (c)(1),
(2), (4) Date: May 17, 2012

(87) PCT Pub. No.: WO2011/064690

PCT Pub. Date: Jun. 3, 2011

(65) Prior Publication Data

US 2012/0230775 A1 Sep. 13, 2012

(30) Foreign Application Priority Data

Nov. 25, 2009 (DE) ..... 20 2009 015 653 U

(51) Int. Cl.
*E02D 29/00* (2006.01)
*E21D 23/06* (2006.01)
*E21D 23/04* (2006.01)

(52) U.S. Cl.
CPC ..... *E21D 23/06* (2013.01); *E21D 23/04* (2013.01)

(58) Field of Classification Search
CPC . E21D 21/0086; E21D 21/0093; E21D 11/40; E21D 11/107; E21D 23/03; E21D 23/04; E21D 23/06
USPC ..... 405/293, 294, 296, 288
See application file for complete search history.

(56) References Cited

U.S. PATENT DOCUMENTS

| | | | | |
|---|---|---|---|---|
| 3,383,866 | A | 5/1968 | Groetschel | |
| 3,514,961 | A | 6/1970 | Shuttleworth | |
| 3,872,678 | A | 3/1975 | Shuttleworth | |
| 3,949,563 | A * | 4/1976 | Wertelewski et al. | 405/296 |
| 4,118,939 | A | 10/1978 | Saunders | |
| 4,121,426 | A | 10/1978 | Heyer | |
| 4,573,828 | A | 3/1986 | Jones et al. | |
| 4,648,458 | A | 3/1987 | Broadus | |
| 5,423,638 | A | 6/1995 | Merriman | |

FOREIGN PATENT DOCUMENTS

| | | |
|---|---|---|
| CN | 1526914 | 9/2004 |
| CN | 201121525 | 9/2008 |
| DE | 10 75 518 | 2/1960 |
| DE | 198 14 246 A1 | 10/1999 |
| DE | 10 2008 029 085 B3 | 1/2010 |

(Continued)

*Primary Examiner* — Doug Hutton, Jr.
*Assistant Examiner* — Patrick Lambe

(57) ABSTRACT

A shield canopy for a shield-type support for underground mining having a canopy plate and a supporting structure being welded on below the canopy plate and having a plurality of longitudinal spars which extend from a rear canopy region up to a front canopy region. At least two of the longitudinal spars having section struts which are provided with a top section flange and a web running perpendicularly to the top section flange, and the canopy plate and the section struts are angled upwards in the front canopy region.

18 Claims, 2 Drawing Sheets

(56) References Cited

FOREIGN PATENT DOCUMENTS

| | | |
|---|---|---|
| GB | 2 126 639 A | 3/1984 |
| RU | 2232897 | 7/2004 |
| RU | 2254480 | 6/2005 |
| SU | 106952 | 11/1956 |
| SU | 872772 | 10/1981 |
| SU | 1191596 | 11/1985 |

* cited by examiner

SHIELD CANOPY FOR A SHIELD-TYPE SUPPORT

The invention relates to a shield canopy for a shield-type support for underground mining, comprising a canopy plate, comprising accommodating devices for connecting the heads of hydraulic props to the shield canopy, and comprising a supporting structure which is welded on below the canopy plate and has a plurality of longitudinal spars which extend from a rear canopy region, in which the accommodating devices are arranged, up to a front canopy region, in which the longitudinal spars taper in their height.

BACKGROUND OF THE INVENTION

Powered support assemblies which can be varied in height by means of hydraulic cylinders (hydraulic props) have been used in underground mining for decades, said powered support assemblies having, as a rule, two floor skids, a guide bar mechanism, a gob shield and a one- or multi-piece shield canopy connected to the gob shield in an articulated manner. By extension of the usually two, sometimes also four, hydraulic cylinders, the shield canopy is pressed against the "roof", i.e. the overburden of an underground longwall face, in order to keep a chamber free in the underground formation for the arrangement of the winning machines, said chamber usually being referred to as longwall face. A plurality of shield-type supports or powered support assemblies adjustable in height form an advancing support which can be pulled forward or via which a winning installation can be pushed forward by retracting the hydraulic cylinders and pushing individual shield-type supports via substantially horizontally directed advancing cylinders which are supported against the winning installation.

The powered support assemblies or shield-type supports used in high-output winning operations comprise shield canopies whose canopy plates have lengths of five meters and above and widths of two meters and above. In this case, all the bending forces between canopy tip and canopy end or the accommodating devices for the prop heads have to be absorbed with a high degree of certainty by the supporting structure welded on below the canopy plate in order to avoid fracture of the shield canopy itself in loose or undulating formation against which the shield canopy is pressed. In order to cope with these loads, the powered support assemblies used at present usually have a box-type supporting structure having a multiplicity of longitudinal spars which consist of sheet metal strips and are stiffened via transverse plates.

In a shield-type support having a withdrawal opening, as is described, for example, in DE 198 14 246 A1, two box-section-shaped longitudinal spars are provided which extend over the entire length of the shield canopy and which at the same time form the guide device for a sliding plate in order to provide the withdrawal opening, which can be opened and closed, in the shield canopy for the withdrawal/extraction process.

SUMMARY OF THE INVENTION

An object of the invention is to provide a shield canopy which can be produced at less cost and with lower weight and at the same time has a higher bending resistance than the known structures.

This and other objects are achieved according to the invention in that at least two of the longitudinal spars consist of section struts which have at least one top section flange and a web running perpendicularly to said top section flange, wherein the canopy plate and the longitudinal spars are angled upwards in the front canopy region. By means of the angling of the canopy tip, i.e. angling in the front, tapering canopy region, preliminary arching of the shield canopy which counters the loads in the setting state of a powered support assembly is achieved, and this preliminary arching can significantly improve the overall loading capacity of the shield canopy. The preliminary arching of the shield canopy against the subsequent loading line can possibly be achieved by only simple angling of the foremost portion forming the canopy tip relative to a rear portion of the front canopy region, but may also comprise a plurality of angled configurations.

Depending on the overall length of the shield canopy and the predetermined free projecting design length of the front canopy region, the angled canopy tip can preferably be about 10% to 30%, in particular about 15% to 25%, of the overall length of the shield canopy. Since a box type of construction of a multiplicity of sheet metal strips, welded to one another, or box sections is substantially dispensed with in the solution according to the invention, and since section struts available by the meter can be used instead, a higher bending resistance with reduced weight and at the same time a considerable reduction in the welds required for producing the welded supporting structure can be achieved.

In principle, the preliminary arching of the shield canopy can be achieved in various ways. In a configuration which is simple from the design point of view and is advantageous in terms of costs, the web is provided with an incision, wherein the angling is formed in the region of the incision, and the incision in the web serves to be able to carry out the angling. After the incision is made, e.g. by flame cutting, the foremost portion of the section strut, which after its fitting forms a longitudinal spar in the substructure of the shield canopy, can then be bent over by a small degree of angling, thereby resulting in angling between two otherwise rectilinear section strut portions. The incision in the web preferably extends right up to the top section flange in order to facilitate the angling or bending at the angling point.

In the especially preferred configuration, in order to achieve an especially high bending resistance in the fitted state of the section struts in the substructure of the shield canopy, the incision in the web is at least partly filled with a wedge piece after the angling has been produced. The insertion of a wedge piece can therefore in turn achieve the effect that the web is also solely loaded with compressive loads in the region of the incision and these compressive loads can be positively absorbed despite the incision made beforehand. The wedge piece is preferably welded into the incision.

In an especially preferred configuration, the top section flange of the section strut has a flange arm on both sides of the web. In order to make it easier to produce the angling in a section strut with a top section flange having a flange arm on both sides, both section webs can be provided with arm incisions in alignment with the incision before the angling. After the angling has been produced, the arm portions defining the arm incisions can then be connected again, in particular by means of a weld. However, the angling can also be effected without an additional incision in the flange arms and/or also without further measures, such as provisions at the bending line or the like.

The angling between the canopy tip and the remaining region of the section strut is preferably about 2° to 4°, in particular about 3°. According to the especially preferred configuration, the longitudinal spars or section struts consist of preferably rolled or drawn I-sections having a bottom section flange integrally adjoining the web. It is certainly possible in principle for the bottom section flange on the completed longitudinal spar fitted into the shield canopy to extend up to the canopy tip. In the preferred configuration, however, the bottom section flange is removed, in particular cut away, in the front canopy region. The removal of the bottom section flange is then effected, preferably before the angling has been produced, with a cut which runs in an angled manner at the angling point. The angling of the cut should then preferably be effected with the same angling as the angling of the canopy tip relative to the remaining section strut, so that, after the angling, the underside of the section strut tapers rectilinearly on both sides of the incision and bottom plates can be welded in the front canopy region to the underside of the shield canopy.

Instead of making a cut with which the bottom section flange in the front canopy region is subsequently removed on an I-section strut, the bottom section flange can also be left if, in addition to the incision for carrying out the angling, a portion of the web, in particular that portion of the web which in the I-section was originally located directly adjacent to the bottom section flange, is cut out in order to subsequently press or roll the bottom section flange onto the cut edge and then weld it again thereto, as is described in detail in DE 10 2008 029 085 A1 (not pre-published) of the applicant, to the disclosure content of which reference is additionally made in this respect.

Alternatively, the longitudinal spars can consist of T-sections, in which the incisions are then accordingly made in the web and there is no second section flange running perpendicularly to the web. In the case of longitudinal spars which consist of T-sections, a web plate can be welded as bottom flange to the web, at any rate in the rear canopy region.

According to an advantageous configuration, the top section flange and/or the bottom section flange, at least in the rear canopy region, can extend in each case with a flange arm on both sides of the web. Here, the flange arms of the top and the bottom section flanges can have width and thickness dimensions identical to one another. The corresponding longitudinal spar can then therefore consist of a symmetrical I-section strut which is appropriately adapted by incisions and severing. With respect to the web, the flange arms on one side can also have a greater thickness and/or a greater width than the flange arms on the other side of the web. For such a configuration, in particular asymmetrical I-section section struts can be used, or a symmetrical I-section strut is appropriately adapted by additional cuts. Both configurations of I-section struts can also be used in a shield canopy.

To facilitate the fitting of the accommodating device, it is especially advantageous if the bottom and top flange arms in the rear canopy region are partly provided with cut-outs for positioning the accommodating devices for the prop heads. The reduction in the bending resistance caused by the cut-outs in the bottom section flange or top section flange can be compensated for, inter alia, by the accommodating devices being welded to the flange arms of the top section flanges above the cut-outs. The top and the bottom flange arms can be partly provided with cut-outs in the region of the accommodating devices for the prop heads, said cut-outs extending right up to the web. Furthermore, it is advantageous if the top section flanges of all the section struts are welded to the underside of the canopy plate via longitudinal welds and/or if the shield canopy acquires a supporting structure having four longitudinal spars consisting of section struts.

These and other objects, aspects, features, developments and advantages of the invention of this application will become apparent to those skilled in the art upon a reading of the Detailed Description of Embodiments set forth below taken together with the drawings which will be described in the next section.

DETAILED DESCRIPTION OF EMBODIMENTS

Figure 1:
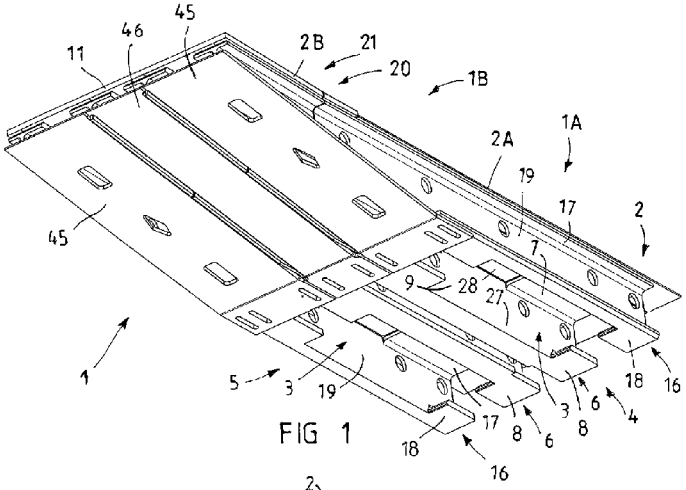
FIG. 1 shows, in a perspective view from below, a shield canopy according to the invention, without accommodating devices for prop heads and hinge pin connections.
Figure 2:
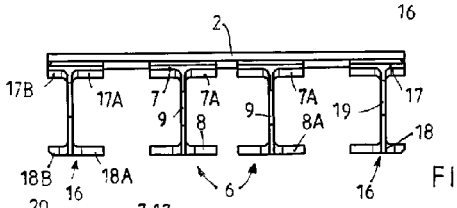
FIG. 2 shows a view of the rear side of the shield canopy according to FIG. 1.

Referring now to the drawings wherein the showings are for the purpose of illustrating preferred and alternative embodiments of the invention only and not for the purpose of limiting same, FIG. 1 shows, in a schematically highly simplified view, a shield canopy 1 according to the invention for use on a powered support assembly of any desired construction, in particular for underground mining. A powered support assembly (not shown in its entirety) normally has two floor skids, two or four hydraulic props, a gob shield and a guide bar mechanism in order to be able to press the shield canopy 1, with the canopy plate 2 which forms the top side of the powered support assembly, against the "roof" of an underground coal face or the overburden of an underground cavity in the setting state of the powered support assembly. The accommodating devices which are provided for fastening the shield canopy 1 to the hydraulic props and which are fastened to the shield canopy 1 in the positions designated by reference numeral 3 in FIG. 1 and also the hinge connections for connecting the shield canopy 1 to a gob shield, which are normally arranged on the rear side 4 of the shield canopy 1, are not shown.

As can readily be seen from FIG. 1, the shield canopy 1 has a substructure 5 which is welded to the underside of the canopy plate 2 and is formed, in the exemplary embodiment shown, by two inner section struts 6 and two outer section struts 16 as longitudinal spars. In the exemplary embodiment shown, all the section struts 6, 16 originally consist of I-section section struts (I-section struts), which, however, are adapted for use as longitudinal spars in the substructure. Here, both section struts 6, 16 have, in an integral manner, a top section flange 7 or 17, respectively, a bottom section flange 8 or 18, respectively, and a web 9 or 19, respectively, running perpendicularly to the two section flanges 7, 8 and 17, 18, respectively. The respective top section flange 7 or 17 of the section struts is connected to the canopy plate 2 via welds, and the canopy plate 2 is supported virtually over the entire length of the shield canopy 1 on the top section flanges 7, 17 of the section struts 6, 16 forming the longitudinal spars of the substructure 5. The shield canopy has a rear canopy region 1A, in which it has an approximately uniform height and in which the accommodating devices (not shown) for the prop heads are positioned, and a front canopy region 1B, in which the height of the shield canopy 1 tapers continuously here towards the canopy end face 11.

According to the invention, angling designated overall by reference numeral 20 is formed at least in the front canopy region 1B, by means of which angling a portion of the shield canopy which is located between the angling 20 and the front end face 11 and which is designated here as canopy tip 21 runs in an angled manner to the entire further region of the shield canopy 1. The angling at the angling point 20 also includes in particular the canopy plate 2. To this end, the canopy plate 2, in the exemplary embodiment shown, consists of a rear plate portion 2A and a front plate portion 2B designed here to be slightly more rigid, wherein the plate portion 2B at the angling point 20 has angling in accordance with the angling of the entire shield canopy 1. The angling or the degree of angling at the angling point 20 between the canopy tip 21 and the remaining portion of the front canopy region 1B and the entire rear canopy region 1A is 3° here, and the angling runs upwards towards the roof with respect to a finished shield canopy 1. The effect achieved by this is that the forces transmitted from the roof to the shield canopy 1 during the setting of a powered support assembly must first overcome the preliminary arching of the shield canopy 1 achieved via the angling.

It can readily be seen from the rear view of the shield canopy 1 according to FIG. 1 that the two inner section struts 6 of the supporting structure 5 each consist of symmetrical I-section struts, in which both the top section flange 7 and the bottom section flange 8 have flange arms 7A and 8A, respectively, of the same thickness and width on both sides of the web 9. Here, the respective outer section struts 16 consist of asymmetrical I-section struts, in which the flange arms 17A and 18A, respectively, on one side of the web 19 have a greater width than the flange arms 17B, 18B on the other side of the web 19. The different width of the flange arms 17A, 17B relative to one another and/or relative to the flange arms on the inner section struts 6 can be achieved, for example, by the use of different I-section struts for the inner section struts 6 on the one hand and the outer section struts 16 on the other hand. Alternatively, however, the outer section struts 16 could also be produced by appropriate cutting-to-size of the respectively shorter flange arms 17B, 18B from the same I-section struts as the inner section struts.

Figure 3:
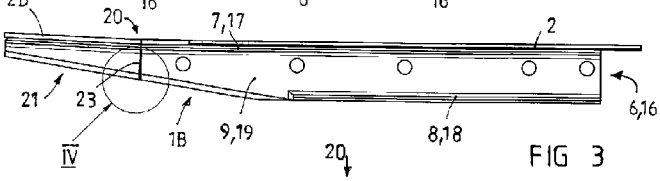
FIG. 3 shows a side view of the shield canopy from FIG. 1.
Figure 4:
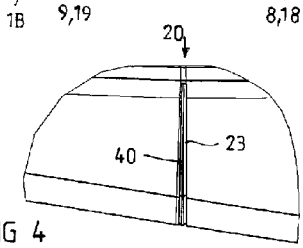
FIG. 4 shows the detail IV in FIG. 3.
Figure 5:
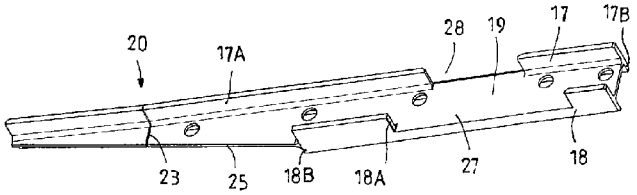
FIG. 5 shows, in a perspective view, a section strut adapted in the shield canopy according to FIG. 1 as a longitudinal spar of the substructure.
Figure 6:
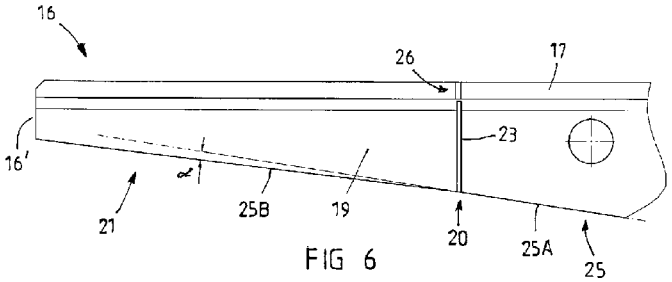
FIG. 6 shows the front region of a section strut before the angling operation, in side view.
Figure 7:
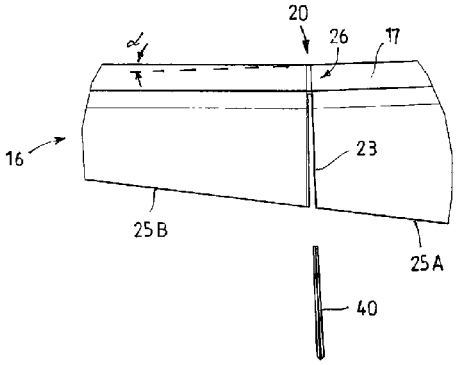
FIG. 7 shows a detail view of the incision in the section strut before the insertion of a wedge piece.

FIGS. 3 and 4 illustrate especially clearly the angling of the shield canopy 1 in the front canopy region 1B at the angling point 20. The angling is designed in an identical manner in all the section struts 6, 16, and the angling of the front canopy tip 21, as will be explained in detail with reference to FIGS. 5 to 7, is preferably achieved by the section struts 6, 16 first being provided with an incision 23 in the front canopy region or in that portion which subsequently forms the substructure 5 in the front canopy region 1B in the shield canopy, said incision 23 extending in the web 9, 19 right up to the top section flange 7, 17. By the severing of the web 9, 19 at the angling point 20, the portion lying on one side of the incision 23 can then be angled or bent away relative to the portion located on the other side of the incision, as a result of which the previously rectangular incision 23 is enlarged in a wedge shape. After the angling, the incision 23 can then be filled again with a wedge piece 40, which is preferably welded into the incision 23.

To illustrate the production or adaptation of the section struts 6, 16 forming the longitudinal spars in the shield canopy 1, reference will now first be made to FIGS. 5 to 7, in which one of the two outer section struts 16 is shown by way of example. As explained further above, the initial section for the section strut 16 forms a drawn or rolled I-section bar with web 19, top section flange 17 and bottom section flange 18. The section strut 16 is adapted in such a way that the top section flange 17 certainly extends over the entire length of the section strut 16. The bottom section flange 18, on the other hand, extends only over about half the length of the section strut 16, for which purpose the entire front portion of the section strut 16 is provided with a separating cut in the web 19, with which the bottom section flange normally integrally formed in the I-section is cut away in the front region. The cut edge on the web 19 is designated by reference numeral 25 in FIG. 5. FIG. 6, in a detail view of the front portion of the section strut 16, shows the production or adaptation state before the angling at the angling point 20 has been produced. An incision 23 is certainly made in the web 19 of the section strut 16, and this incision 23 extends in the web 19 right up to the top section flange 17. However, the top section flange 17 still runs rectilinearly on both sides of the subsequent angling point. The cut edge 25 on the underside of the web 19 is directed in such a way that a first cut edge portion 25A extends right up to the incision 23, whereas a second cut edge portion 25B runs in an angled manner at the angle α. Here, the cut edge portion 25B extends rectilinearly up to the front tip 16' of the section strut 16. In the shield canopy according to the invention, this front portion subsequently forms the canopy tip. The angle α of the angling between the cut edge portions is preferably about 3° and corresponds in this respect exactly to that degree α of angling which the section strut 16 is given after the angling has been carried out. FIG. 7 shows this final production state of the section strut 16. After the angling relative to the incision 23 has been carried out, the cut edges 25A, 25B are in alignment with one another, whereas the top section flange 17 is angled at the angle α at the angling point 20.

Only after that is the incision 23 filled with a wedge piece 40 and welded. In order to make it easier to produce the angling, the two flange arms 17A and 17B, respectively, of the top section flange 17, as schematically indicated, can be provided with arm incisions 26 at the same height as the angling point 20 or the incision 23 before this step. Since the angling in the region of the flange arms 17A, 17B does not lead to a relatively large gap, the incisions 26 can subsequently be completely closed again by the roots of a weld. However, the angling can also be effected without additional measures carried out at the top section flange.

FIGS. 1 and 5 readily show that the section struts 6 and 16 are in each case provided on one side with cut-outs 27 and 28, respectively, in both the top section flanges 7, 17 and the bottom section flanges 8, 18. These cut-outs provide sufficient free space for positioning the accommodating devices (not shown) for prop heads, and the latter can be welded and anchored not only to the bottom plate (2, FIG. 1) but also to the section struts 6, 16 forming the longitudinal spars of the shield canopy 1. In the exemplary embodiment shown, the cut-outs 27 and 28, respectively, partly or completely dispense with the need for the flange arms of the section flanges 7, 8, 17, 18 on one side.

FIG. 1 shows that the front plate portion 2B for the canopy plate 2 is also provided with angling, which, however, can also possibly be carried out without an incision on account of the structure. In the front canopy region 1B, a bottom plate 46 is welded on between the webs 9 tapering towards the canopy front side, on both sides of which further bottom plates 45 are arranged, which are welded to the bottom edge of the webs 19 of the outer section struts 16. All the bottom plates 45, 46 have a folded portion which, in the rear canopy region 1B, bears against and is welded to the underside of the bottom section flanges 8, 18.

For the person skilled in the art, numerous modifications which are to come within the scope of protection of the attached claims emerge from the above description. Instead of continuous I-sections, correspondingly profiled cast sections which are already provided with corresponding angling during the primary forming could also be used. Alternatively, sections having a T cross section could be used, to which the bottom flanges are welded. Such modifications and other modifications are to come within the scope of protection of the attached claims.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A shield canopy for a shield-type support for underground mining, the shield canopy comprising a top canopy plate, comprising devices for connecting associated prop heads to the shield canopy, and comprising a supporting structure which is welded on below the top canopy plate and has a plurality of longitudinal spars which extend from a rear canopy region, wherein the rear canopy region is configured to receive accommodating devices for the associated prop heads, up to a front canopy region, in which the longitudinal spars taper in their height, at least two of the plurality of longitudinal spars have section struts which are each provided with a top section flange and a web running perpendicularly to the top section flange, the top canopy plate having an angled portion at the front canopy region which is angled upwards relative to a rear portion of the top canopy plate, and the section struts being angled to substantially match the angled portion of the top canopy plate, and the web is provided with an incision, wherein the angled portion is formed in the region of the incision.

2. The shield canopy according to claim 1, wherein the incision in the web reaches up to the top section flange.

3. The shield canopy according to claim 2, wherein the top section flange has a flange arm on both sides of the web.

4. The shield canopy according to claim 3, wherein both flange arms are provided with an arm incision in alignment with the incision, wherein arm portions defining the arm incisions are connected by a weld.

5. The shield canopy according to claim 1, wherein the incision in the web is at least partly filled with a wedge piece.

6. The shield canopy according to claim 5, wherein the wedge piece is welded into the incision.

7. The shield canopy according to claim 1, wherein the angled portion has an upward angle of about 2° to 4° relative to the rear portion.

8. The shield canopy according to claim 7, wherein the upward angle is about 3°.

9. The shield canopy according to claim 1, wherein the section struts forming the plurality of longitudinal spars are formed by I-sections having a bottom section flange integrally adjoining the web.

10. The shield canopy according to claim 9, wherein the bottom section flange is removed or cut away in the front canopy region.

11. The shield canopy according to claim 10, wherein the angled portion is formed at an angling point, the removal of the bottom section flange in the front canopy region is effected with a cut which runs in an angled manner at the angling point.

12. The shield canopy according to claim 9, wherein the top section flange and the bottom section flange, at least in the rear canopy region, extend in each case with flange arms on both sides of the web.

13. The shield canopy according to claim 12, wherein, within each of the section struts the flange arms of the top and the bottom section flanges have identical width and thickness dimensions.

14. The shield canopy according to claim 12, wherein the flange arms on one side have at least one of a greater thickness and a greater width than the flange arms on the other side of the web.

15. The shield canopy according to claim 12, wherein the flange arms include top flange arms and bottom flange arms, the top flange arms and the bottom flange arms include cutouts in the region of the associated accommodating devices for the associated prop heads.

16. The shield canopy according to claim 1, wherein the section struts forming the longitudinal spars are formed from T-sections, wherein a web plate is welded as a bottom flange to the web.

17. The shield canopy according to claim 1, wherein the top section flanges of all the section struts are welded to the underside of the top canopy plate via longitudinal welds.

18. The shield canopy according to claim 1, wherein the at least two longitudinal spars having the section struts is four longitudinal spars having section struts.

* * * * *